US007770977B2

(12) United States Patent
Diller

(10) Patent No.: US 7,770,977 B2
(45) Date of Patent: Aug. 10, 2010

(54) FLOATING BEARING AND CLAMP SYSTEM FOR PATIENT PROCEDURES CHAIR MOUNTING AND POSITIONING POSTS

(75) Inventor: Mark G. Diller, Clayton, OH (US)

(73) Assignee: Midmark Corporation, Versailles, OH (US)

( * ) Notice: Subject to any disclaimer, the term of this patent is extended or adjusted under 35 U.S.C. 154(b) by 238 days.

(21) Appl. No.: 11/858,529

(22) Filed: Sep. 20, 2007

(65) Prior Publication Data

US 2009/0079251 A1 Mar. 26, 2009

(51) Int. Cl.
*A47C 7/36* (2006.01)
*A61G 15/00* (2006.01)

(52) U.S. Cl. ..... 297/410; 297/284.9

(58) Field of Classification Search ..... 297/410, 297/344.18, 284.9, 411.35
See application file for complete search history.

(56) References Cited

U.S. PATENT DOCUMENTS

| | | | | | |
|---|---|---|---|---|---|
| 320,806 | A * | 6/1885 | Long | 297/374 |
| 1,728,025 | A * | 9/1929 | Weber | 297/391 |
| 2,306,031 | A | 12/1942 | Anderson et al. | |
| 3,223,447 | A * | 12/1965 | Terracini | 297/397 |
| 3,609,779 | A | 10/1971 | Oja et al. | |
| 3,854,772 | A * | 12/1974 | Abrahamson et al. | 297/353 |
| 4,021,028 | A | 5/1977 | Weber et al. | |
| 4,387,888 | A | 6/1983 | Marinakis | |
| 4,620,697 | A | 11/1986 | Pithon | |
| 4,678,232 | A * | 7/1987 | Ishida et al. | 297/408 |
| 5,177,823 | A * | 1/1993 | Riach | 5/636 |
| 5,427,436 | A | 6/1995 | Lloyd | |
| 6,151,734 | A | 11/2000 | Lawrie | |
| 6,276,012 | B2 | 8/2001 | Borders | |
| 6,397,414 | B1 | 6/2002 | Lloyd | |
| 6,446,287 | B2 | 9/2002 | Borders | |
| 6,578,215 | B1 | 6/2003 | Heimbrock et al. | |
| 6,616,236 | B1 * | 9/2003 | Su | 297/410 |
| 6,718,580 | B2 | 4/2004 | Heimbrock et al. | |
| 6,718,582 | B1 * | 4/2004 | Tinsley | 5/640 |
| 6,754,923 | B2 | 6/2004 | Borders et al. | |
| 6,928,676 | B1 | 8/2005 | Schwaegerle | |
| 7,407,231 | B2 * | 8/2008 | Kraft et al. | 297/410 |
| 7,544,007 | B2 * | 6/2009 | Easton | 403/322.4 |
| 2003/0115674 | A1 | 6/2003 | Heimbrock et al. | |

* cited by examiner

*Primary Examiner*—Sarah B McPartlin
(74) *Attorney, Agent, or Firm*—Wood, Herron & Evans, L.L.P.

(57) ABSTRACT

The headrest and side rails of a patient procedures chair are mounted on posts which are slidably received in elongated, self-aligning or floating plastic bearings. With this construction, any misalignment of the posts due to manufacturing tolerances will be accounted for as the bearings readjust themselves. Clamping devices engage the bearings and cause deformation to increase the frictional engagement of the bearings with the posts to the point where the posts are locked into place. In this regard, actuation of the clamps is accomplished by large knobs that protrude from the back of the chair for ready accessibility.

6 Claims, 9 Drawing Sheets

FLOATING BEARING AND CLAMP SYSTEM FOR PATIENT PROCEDURES CHAIR MOUNTING AND POSITIONING POSTS

BACKGROUND OF THE INVENTION

Patient procedures chairs designed for otolaryngologists, plastic surgeons, dermatologists, oral maxillofacial surgeons and other specialists who require maximum access to the head and neck areas of patients are typically provided with mechanism for positioning the chair's headrest at selected positions relative to the back section of the chair. In a somewhat different aspect it is conventional to provide side rails on such chairs and other patient tables to support various accessories. It is desirable, in this context, to be able to position the rails outwardly of the sides of the chair or table, or inwardly along their sides to allow the physicians to have better access to their patients. In either case, the mechanism for positioning the headrests or rails is often cumbersome and inconvenient to operate.

SUMMARY OF THE INVENTION

A patient procedures chair in accordance with the present invention is provided with a convenient, efficient and unobtrusive mechanism for mounting and positioning the chair headrest and side rails. Essentially, the same components comprise the mechanism for mounting and positioning the posts carrying the headrest and for mounting and positioning the posts carrying the side rails. In each, the posts are slidably received in self-aligning, plastic bearings that guide the posts as the headrest and the side rails are independently adjusted to desired positions.

The back of the chair is provided with a rigid frame and portions of the frame may cooperate with clamps to apply pressure to the bearings and deform them. The deformation increases the friction between the bearings and posts to thereby lock the posts in place. Specifically, the clamps are generally U-shaped in cross section and each clamp engages a pair of posts. Intermediate the posts of each pair, a boss is formed on an inner surface of the bight of the U-shaped clamps and a threaded socket is formed in the boss. An opening is formed through the back frame in line with the threaded socket of each boss and a complementarily threaded shaft extends through the opening and is threadably received in the threaded socket. A handle is fixed to an outer end of the threaded shaft projecting through the openings in the back frame, so that by twisting the handle the clamp may be drawn toward the opposing portion of the back frame to clamp the bearings and thereby fix the position of the posts received therein.

Resilient washers are mounted on inner ends of the side rail posts to engage the portions of the back frame to limit extension of the side rail posts outwardly and cushion their engagement with the back frame as the side rails reach their outermost position. With respect to the posts carrying the headrest, a bumper is mounted on a front surface of the back frame to engage an inner end of one of the headrest supporting posts and resiliently limit inner movement of the headrest. Lastly, a cover is disposed over the rear surface of the back frame and a protuberance is provided on the cover beneath each side rail and intermediate each pair of posts to facilitate manually pulling the side rails outwardly.

DESCRIPTION OF THE PREFERRED EMBODIMENT

Figure 1:
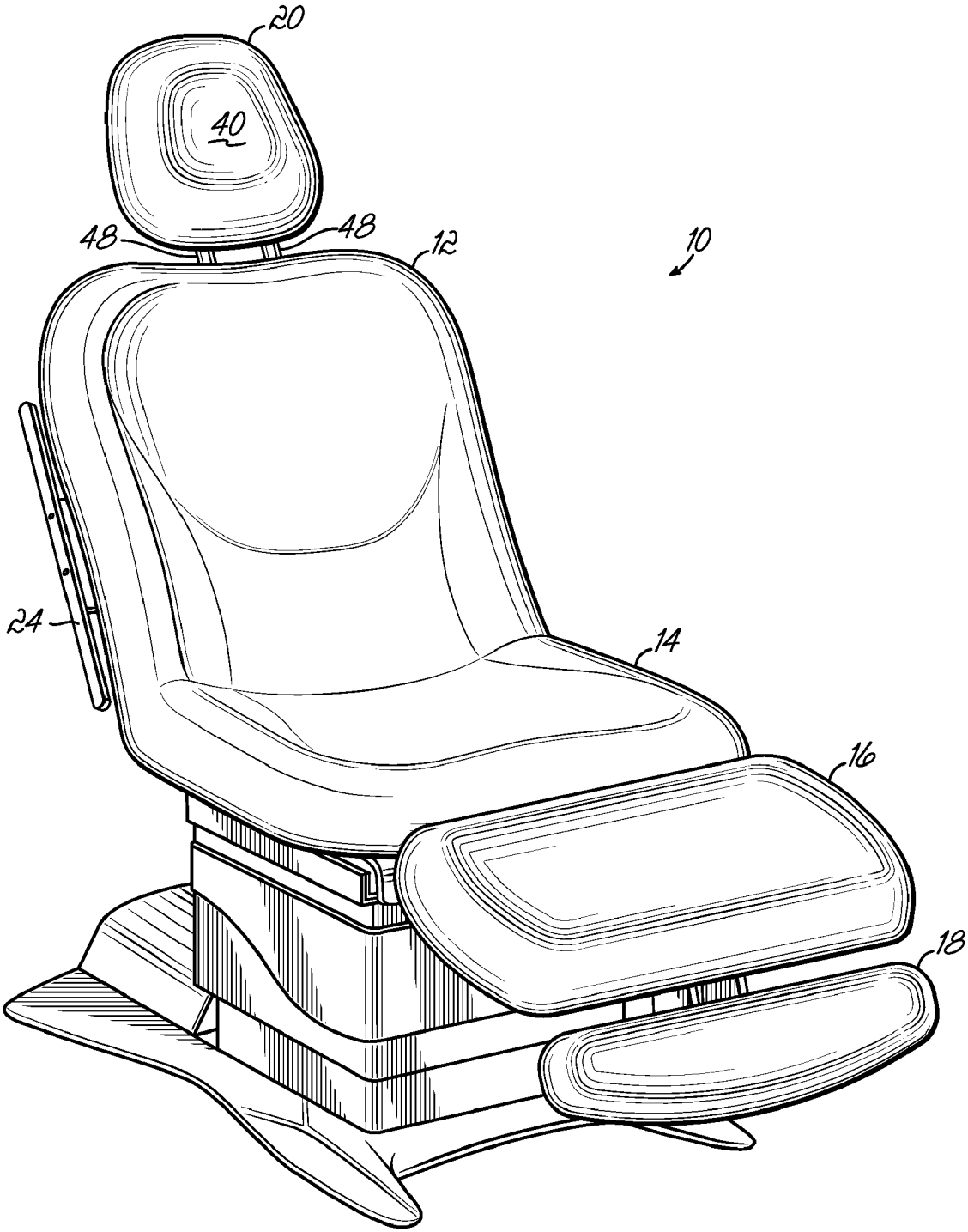
FIG. 1 is a perspective view of a patient procedures chair in accordance with the present invention.
Figure 2:
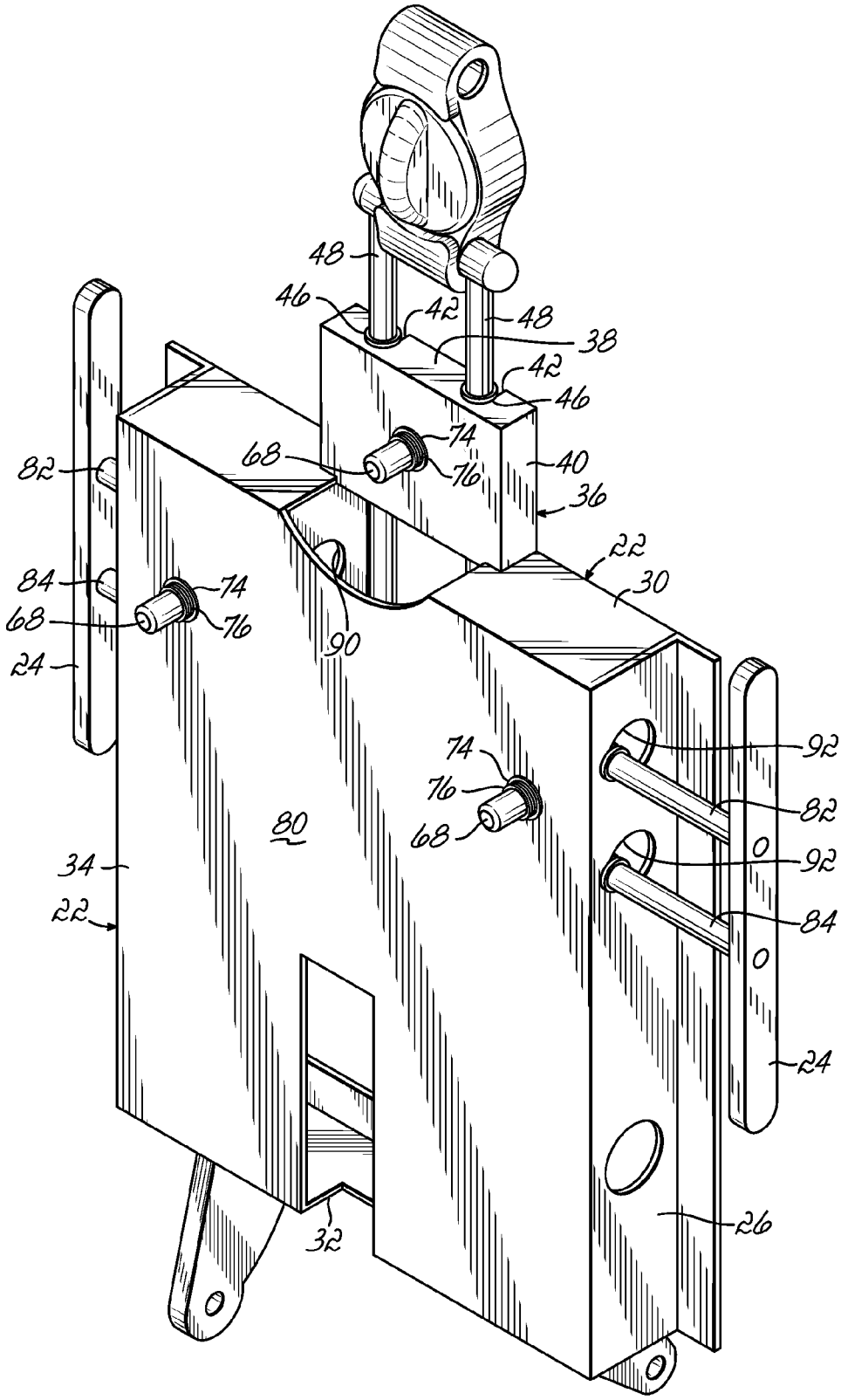
FIG. 2 is a perspective view taken from the rear of the chair of FIG. 1 and showing the rigid back frame and associated side rails, posts and headrest posts.
Figure 3:
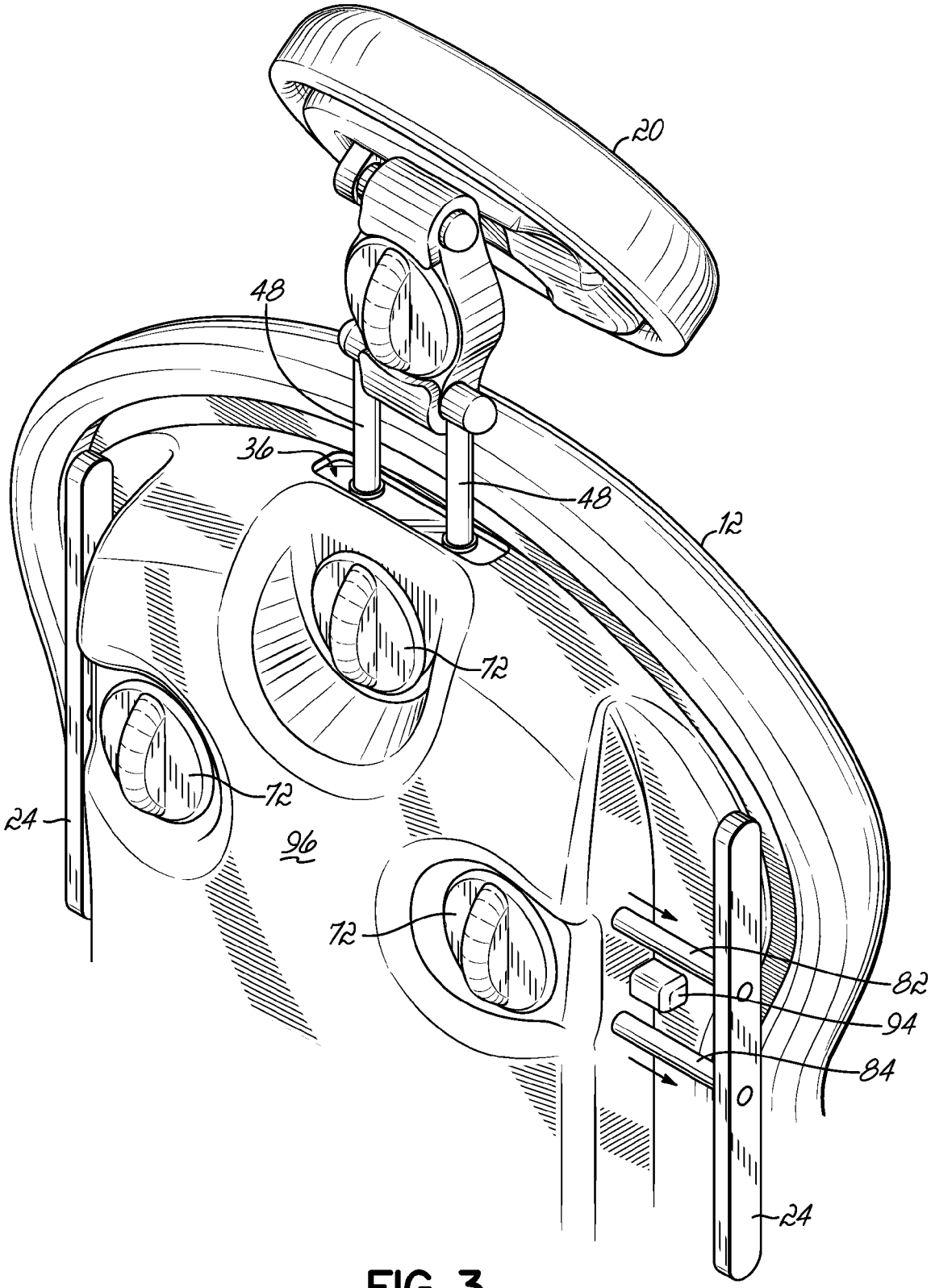
FIG. 3 is a perspective view of the upper rear portion of the back section with a cover in place over the back frame and showing the positioning of the side rails, associated posts, headrest and associated posts.

As seen in FIG. 1 of the Drawings, a chair 10 in accordance with the present invention includes a back section 12, a seat section 14, a leg section 16, a footrest extension 18 and a headrest 20. The back section includes a rigid frame 22 of box-like construction in which are mounted supporting and positioning structures for side rails 24 and the headrest 20. As viewed from the front of the chair, it will be seen in FIG. 4 that the back frame 22 includes upstanding side walls 26 and 28, upstanding upper and lower walls 30 and 32, and a bottom wall 34. Attached to the upper wall 30 by welding or the like is a smaller box-like structure 36, including a top wall 38 and side walls 40.

Figure 9:
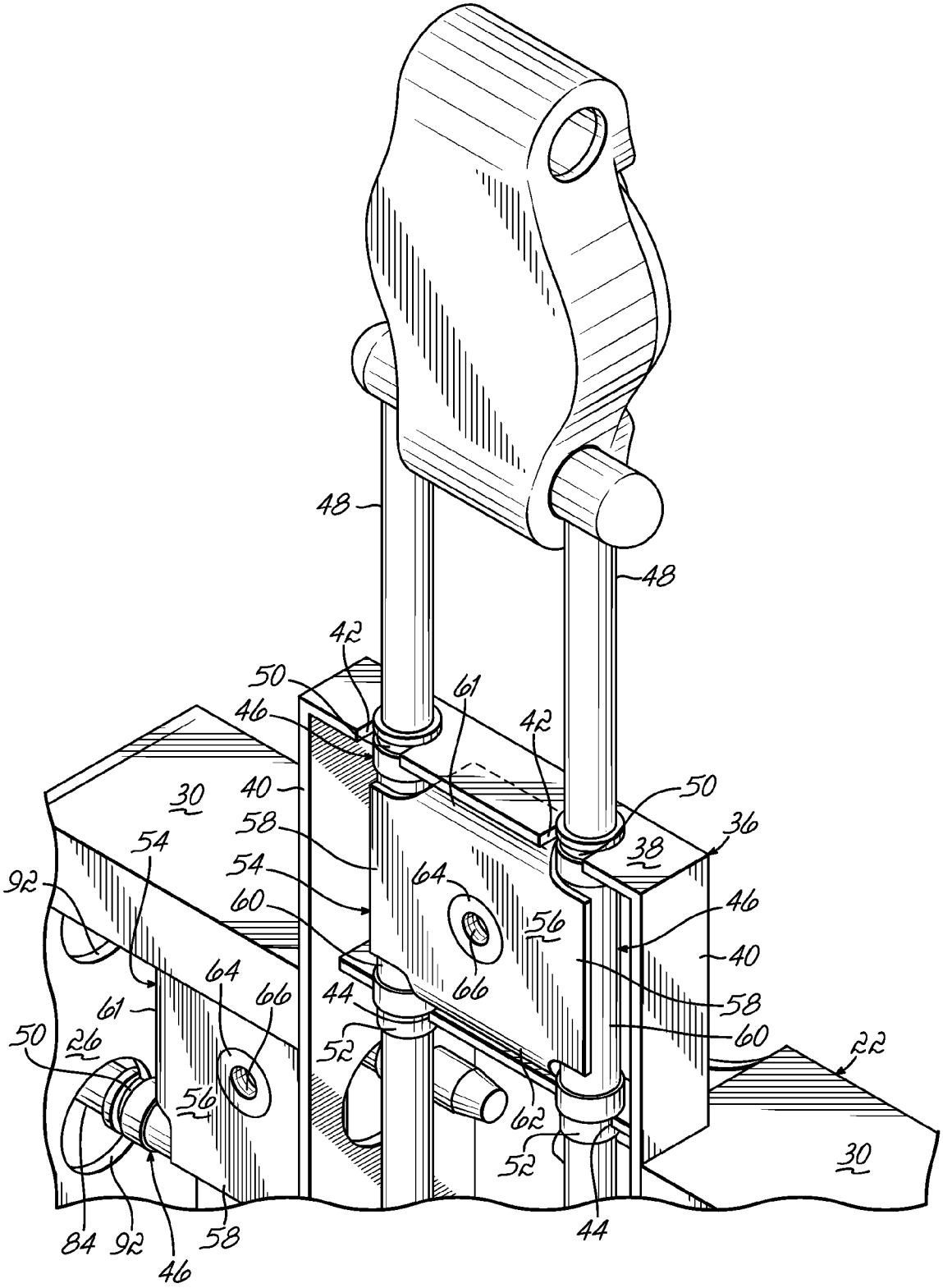
FIG. 9 is a perspective view of a typical clamping mechanism, associated bearings and posts, as viewed from the front of the chair.

As seen in FIG. 9 of the drawings, portions of the top wall 38 are relieved as at 42, as are portions 44 in the upper wall 30 of the back frame 22. As also seen in FIG. 9 of the drawings, the relieved portions 42 and 44 are aligned to received elongated, floating or self-aligning plastic bearings 46, each of which receives and guides a headrest post 48. Each bearing is provided with an annular groove 50 at its upper end and a relieved shouldered portion 52 at its lower end. A generally U-shaped clamp 54 has a central bight portion 56, outwardly extending wings 58 embracing central portions 60 of the bearings 46 and upper and lower leg portions 61 and 62.

Figure 8:
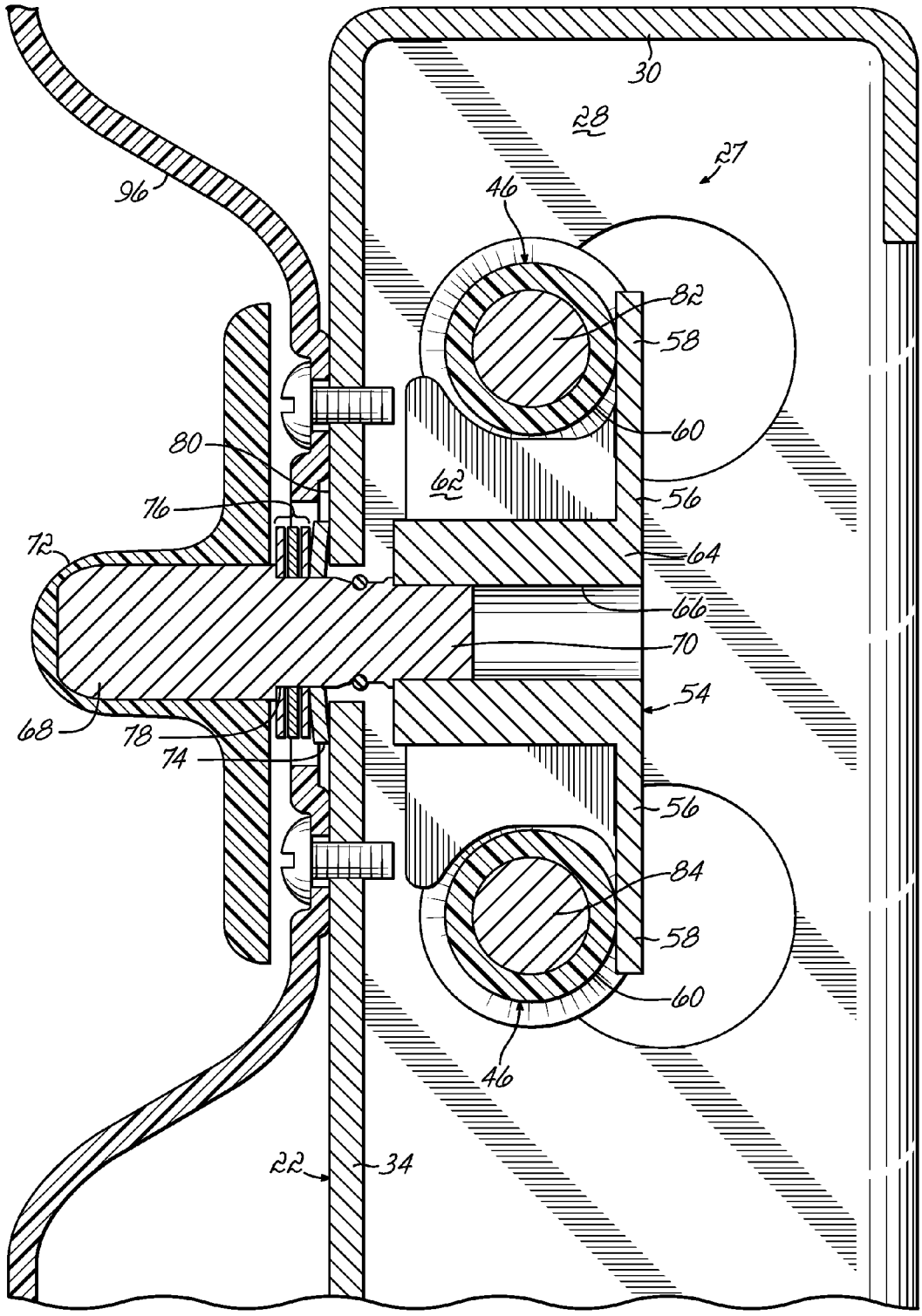
FIG. 8 is a cross sectional view through a clamping mechanism.

The wing portions 58 project over the bearings 46, while the legs 60 and 62 cooperate with the wings 58 and relieved portions 42 and 44 to engage the bearings 46. The bight portion 56 of the clamp 54 is provided with a centrally positioned boss 64 (see also FIG. 8 of the drawings) having a central threaded socket 66. A shaft 68 having a complementarily threaded inner end 70 is received in the socket 66 and has fixed to its outer end a knob 72. While the portion of the structure shown in FIG. 8 of the drawings is the mounting and positioning device for a side rail 24, the clamp, shaft and knob construction depicted in FIG. 8 is identical to that used for positioning and supporting the posts 48 for the headrest 20 and identical parts are referenced with the same reference numerals.

A spring washer 74 is interposed between washers 76 received on a relieved portion 78 of the shaft 68. The spring washer 74 bears, in the embodiment shown in FIG. 8, against the rear surface 80 of the bottom wall 34 of the rigid back frame 22. With this construction, rotation of the knob 72 draws the clamp 54 toward the bottom wall 34, pressurizing and deforming the plastic bearings 46. This deformation increases the friction on the headrest and side rail posts to provide consistent adjustment force or lock them in place. Since the plastic bearings are floating or self-aligning, any misalignment of the posts due to manufacturing tolerances will be accounted for when the bearings readjust themselves.

Figure 4:
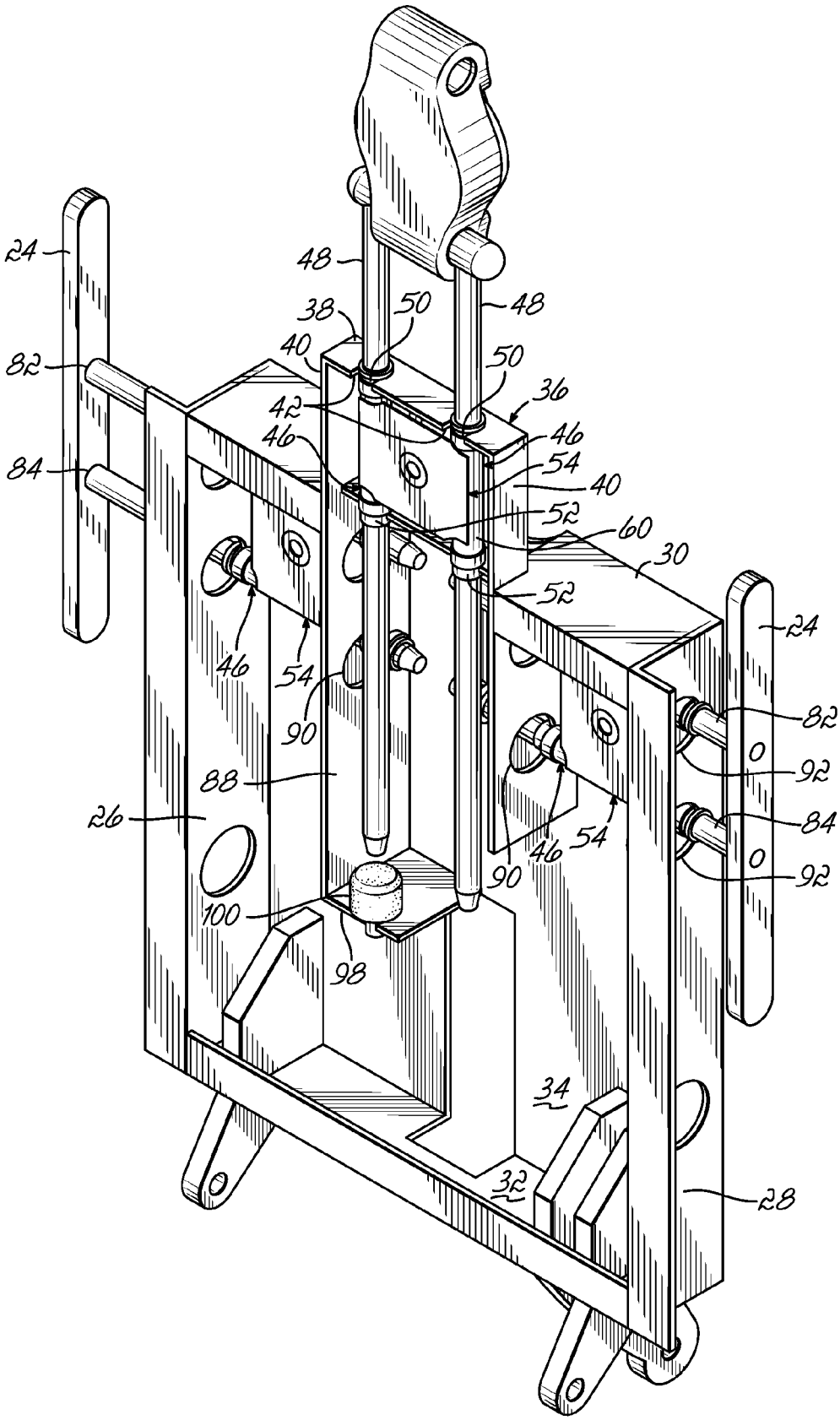
FIG. 4 is a view similar to FIG. 2, but showing the back frame and associated components from the front of the chair.
Figure 5:
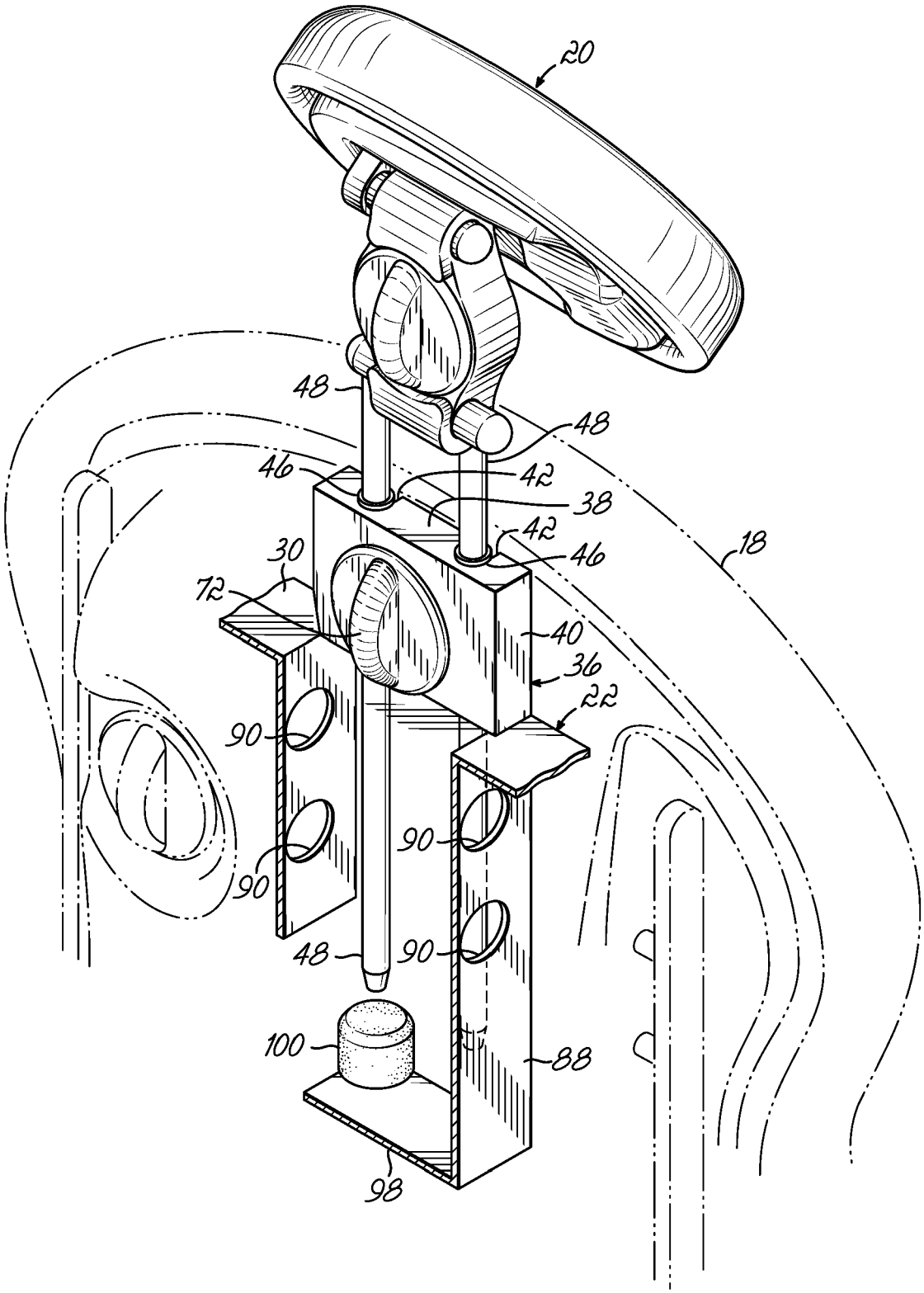
FIG. 5 is a perspective view with parts broken away for clarity taken from an upper rear position of the back section of the chair.
Figure 6:
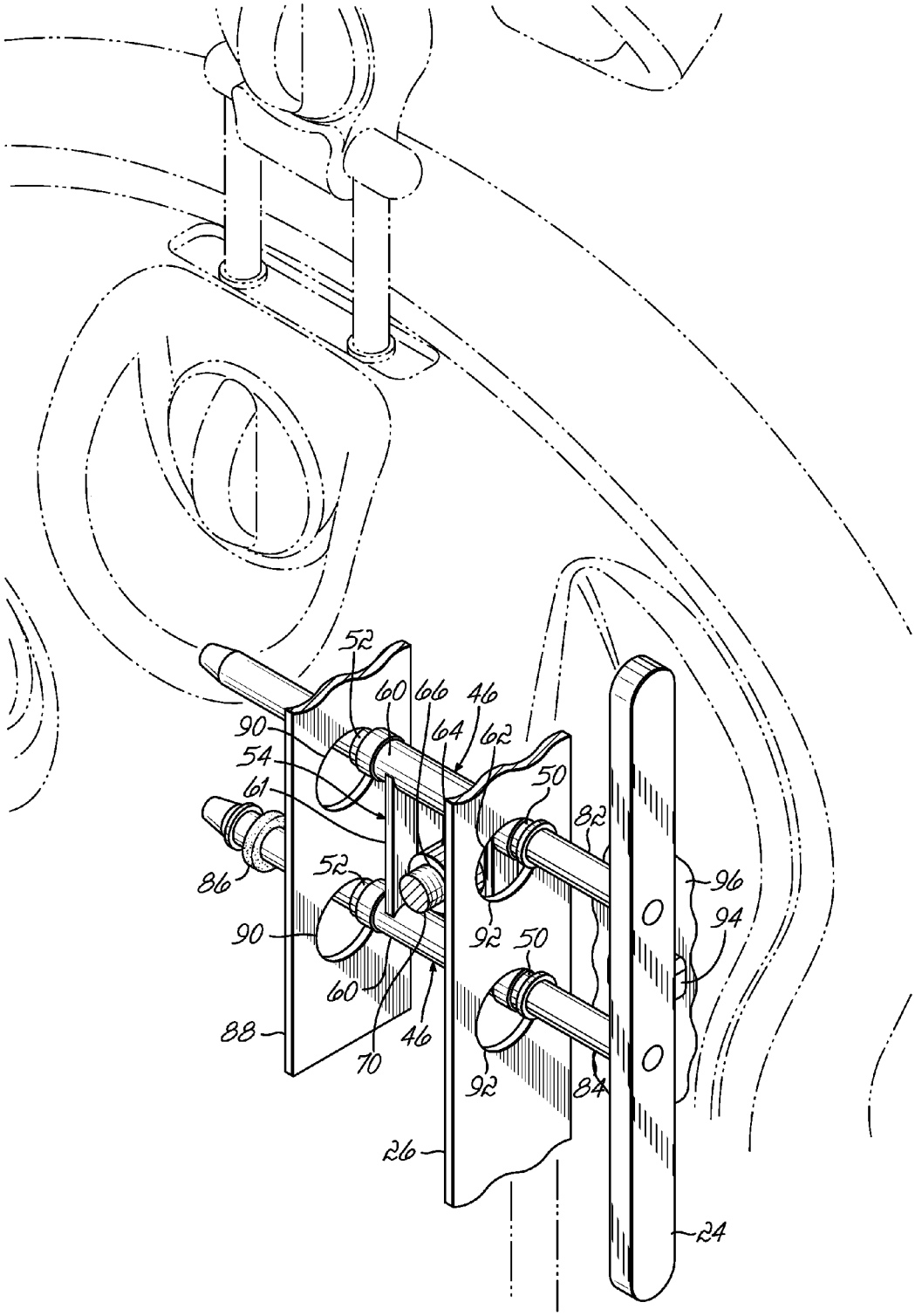
FIG. 6 is also a view of the upper rear portion of the back section with portions broken away for clarity to show a side rail and associated post mounting and positioning construction.
Figure 7:
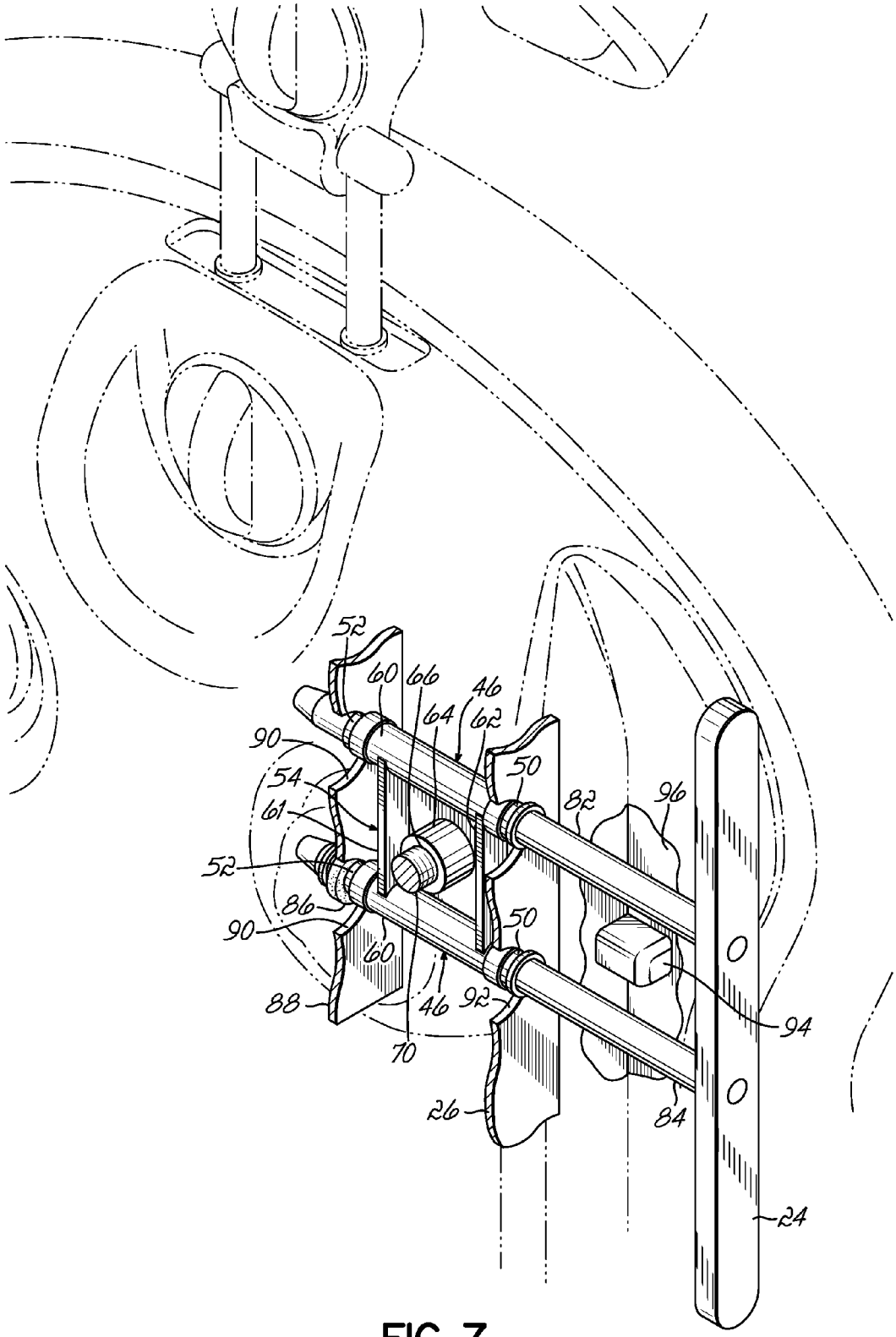
FIG. 7 is a view similar to FIG. 6, but showing the side rail displaced outwardly.

With reference to FIGS. 6 and 7 of the drawings, it will be seen that the side rails 24 are mounted on upper and lower posts 82 and 84, respectively, which in turn are received in upper and lower bearings 46, which are identical to those mounting the headrest posts 48. An inner end of the lower post 84 has mounted thereon a resilient washer 86. As seen in FIG. 4 of the drawings, an upstanding, L-shaped wall 88 is fixed to bottom wall 34 by welding or the like. Openings 90 in wall 88 receive inner ends of bearings 46 at their relieved portions 44. Side wall 26 has openings 92 which engage the annular grooves 50 in the bearings 46. With this construction, when it is desired to move the side rail 24 to its outermost position, the resilient washer 86 will softly engage the upstanding wall 88 and prevent disengagement of the supporting posts from their respective bearings.

To facilitate manually engaging the side rail 24, a protuberance 94 is formed on the rear cover 96 positioned over the rear surface of the back frame 22. As seen in FIG. 7 of the drawings, this protuberance spaces the side rail 24 a slight distance outwardly from the cover so that one may insert their fingers beneath the lower surface of the side rail 24 and manually slide it outwardly. Upstanding wall 88 includes a lateral leg 98 on which is mounted a bumper 100 disposed opposite an inner end of the right hand (as viewed from the rear of the chair) headrest supporting post 48. This serves to limit inward travel of the post and headrest mounted thereon with a cushioning effect as movement is terminated.

From the above, it will be apparent that the present invention provides an efficient and effective mechanism for positioning and mounting headrests and side rails of a patient procedures table.

While the present invention has been illustrated by the description of one or more exemplary embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. In a patient procedure chair, mounting and positioning apparatus comprising:

a pair of essentially straight posts extending in spaced parallel relationship to each other, elongated flexible bearings fixed with respect to said chair, said bearings slidably receiving said posts for movement of said posts longitudinally of said bearings, a rigid frame fixed to said chair, clamps cooperating with said frame and engaging said bearings to restrain movement of said posts within said bearings, said clamps include a boss projecting therefrom toward said frame, a threaded socket formed in said boss, a complementarily threaded shaft threadably received in said socket, an opening formed through said frame in substantial alignment with said threaded socket, said threaded shaft extending through said opening in said frame and into said threaded engagement with said socket, a knob fixed to an end of said threaded shaft opposite the end of said shaft threadably received in said boss, said knob permitting rotational movement of said threaded shaft to move said clamps toward or away from said frame to lock said posts in selected positions or permit sliding adjustment thereof relative to said frame.

2. The patient procedures chair of claim 1 wherein:

said bearings are floating, self-aligning resilient bearings that guide said posts.

3. The patient procedures chair of claim 2 wherein:

said bearings are formed of a resilient material.

4. The patient procedures chair of claim 3 wherein:

said bearings are formed of a plastic material.

5. The patient procedures chair of claim 1 wherein:

said clamps and said frame apply pressure to and deform said bearings, thereby increasing friction on said posts and providing consistent adjustment force or locking them in said selected positions.

6. The patient procedures chair of claim 1 wherein:

said bearings are elongated, and said clamps and said frame engage said bearings at points spaced longitudinally along said bearings.

* * * * *